United States Patent [19]

Anderton

[11] 4,308,657

[45] Jan. 5, 1982

[54] CONNECTOR TERMINATING APPARATUS

[75] Inventor: John J. Anderton, Oil City, Pa.

[73] Assignee: GTE Products Corporation, Stamford, Conn.

[21] Appl. No.: 74,189

[22] Filed: Sep. 10, 1979

[51] Int. Cl.[3] ..... H01R 43/04

[52] U.S. Cl. ..... 29/566.3; 29/749; 29/753

[58] Field of Search ..... 29/749, 753, 751, 566.3, 29/566.4

[56] References Cited

U.S. PATENT DOCUMENTS 3,972,101 8/1976 Casey et al. ..... 29/749

4,005,516 2/1977 Bakermans ..... 29/749

*Primary Examiner*—Carl E. Hall

*Attorney, Agent, or Firm*—Robert E. Walter

[57] ABSTRACT

An apparatus for terminating a plurality of conductors to a connector includes an elongated frame having a connector holding fixture at one end and a carriage mounted for sliding movement toward the fixture for effecting termination of the connector. Movement of the carriage is effected by a beam having a pivotable joint mounted intermediate the carriage and fixture so that movement of the pivotable joint in direction normal to the longitudinal direction of the frame moves the carriage toward and away from the fixture member.

3 Claims, 3 Drawing Figures

CONNECTOR TERMINATING APPARATUS

TECHNICAL FIELD

The present invention relates to an apparatus for terminating a plurality of conductors to a connector.

In the modern electronics industry, it is desirable to provide for the interconnection of various electronic components such as printed wiring boards, cables and the like. Rapid interconnection of components can reduce down time needed for repairs, speed assembly operations and provide for flexibility in circuit design.

The present invention is particularly suited for providing connection of a plurality of conductors such as might be associated with a flat or bundled cable with a connector. In this type of connection, it is generally desirable to align the conductors so that electrical connection may be made with a plurality of electrical contacts. The electrical contacts provide for the interconnection between the cable and an external circuit.

SUMMARY OF THE INVENTION

In accordance with the present invention, there is provided an apparatus for terminating a plurality of conductors to a connector comprising an elongated frame extending along a longitudinal direction, a fixture means at one end of said frame adapted to hold a connector to be terminated, an upright member at the other end of said frame, a beam having a pivotable joint intermediate the ends thereof with one end pivotably mounted to said upright member, a carriage pivotably mounted to the other end of said beam and adapted for sliding movement along the longitudinal direction, said carriage being movable away and toward said fixture member as said pivotable joint moves up and down in a direction substantially normal to said longitudinal direction whereby conductors are terminated to said connector on movement of said carriage toward said fixture.

DETAILED DESCRIPTION OF DRAWINGS

DETAILED DESCRIPTION OF THE INVENTION

Figure 1:
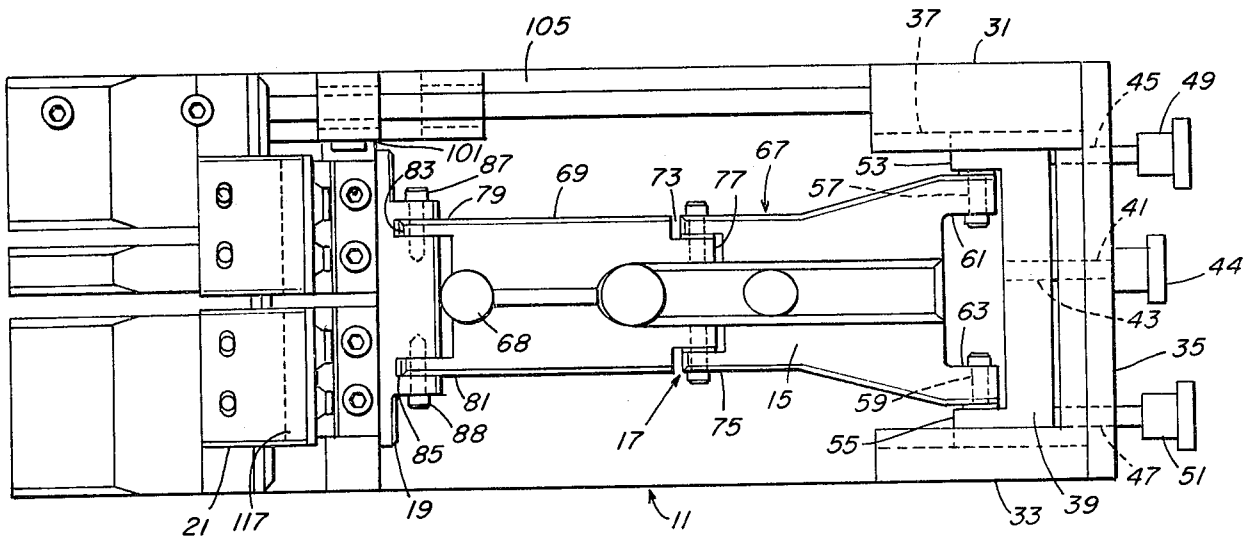
FIG. 1 is a top elevational view of the conductor terminating apparatus.
Figure 2:
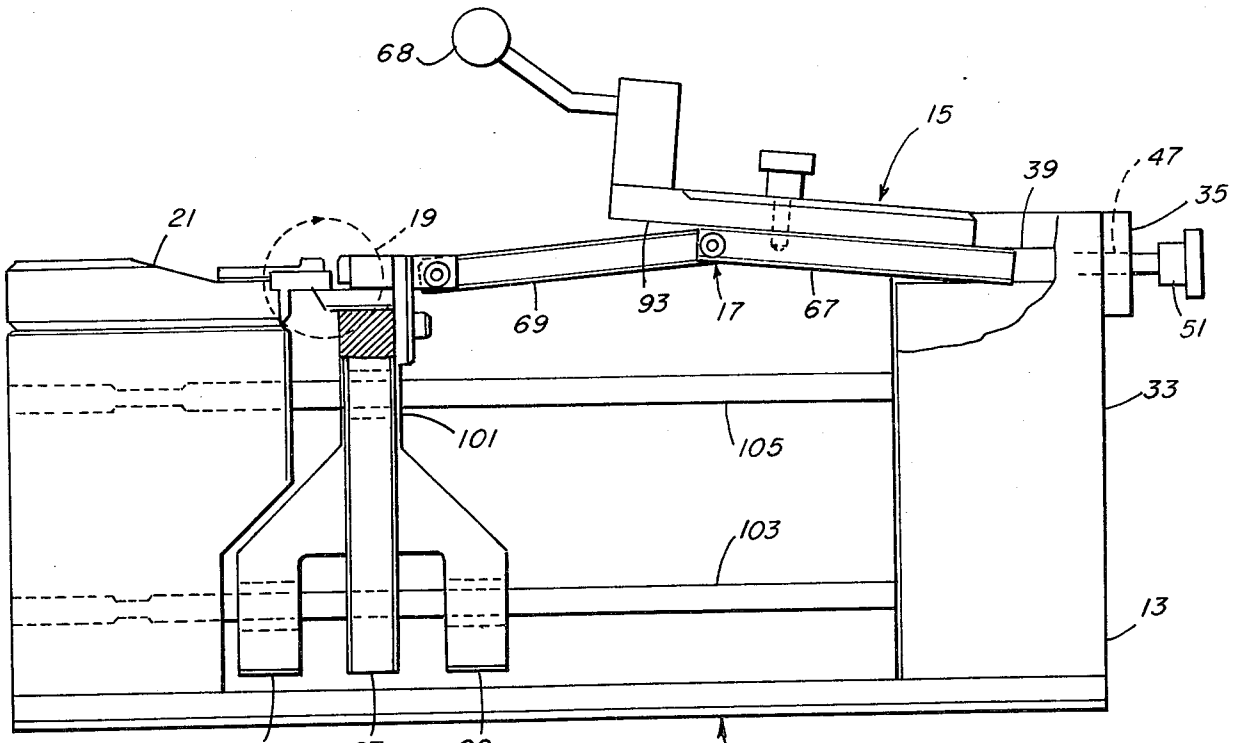
FIG. 2 is a side elevational view of the apparatus of FIG. 1.

As illustrated in FIG. 1, the connector terminating apparatus includes a frame 11 having an upright member 13 at one end thereof. A beam 15 having a pivotable joint 17 is pivotably connected at one end to the upright member 13 and pivotably connected to a carriage 19 at the other end. The carriage 19 is adapted for movement in the longitudinal direction of the frame 11 and for movement toward and away from a fixture 21.

Figure 3:
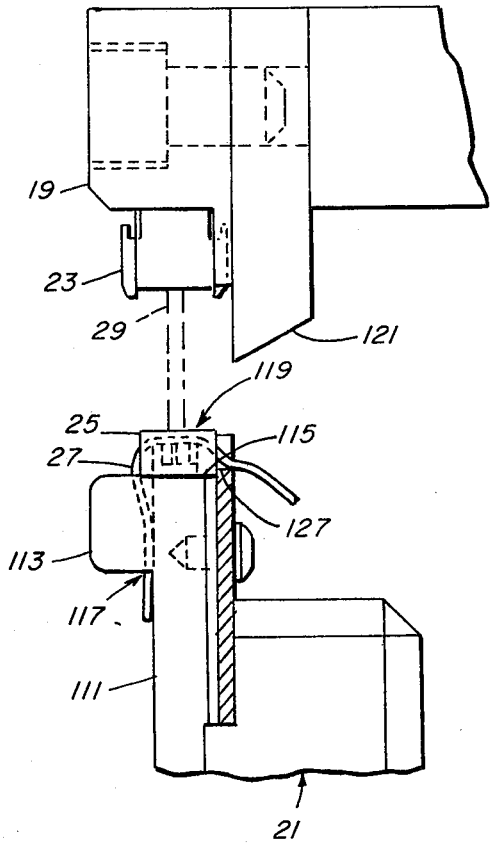
FIG. 3 is a partial detailed side elevational view illustrating termination of a connector.

The connector terminating apparatus, which is particularly suited for terminating a connector of the type illustrated in FIG. 3, includes first elongated body 23 having a plurality of contacts 29 and a second elongated body 25 supporting a plurality of conductors 27. The bodies 25 and 23 which are held apart and supported on the fixture 21 and the carriage 19 move together on hand actuation of the beam 15 so that the contacts 29 engage and make electrical connection with the conductors 27.

The upright member 13 includes a pair of facing sidewalls 31, 33 with a bridging member 35 connected therebetween. Each of these sidewalls 31, 33 have a channel 37 extending in the longitudinal direction. Mounting member 39 positioned between the sidewalls 31, 33 extends into each channel 37 associated with the respective sidewalls 31, 33 so as to be moveable along the longitudinal direction. The bridging member 35 includes a straight smooth bore 41 extending therethrough in alignment with a threaded bore 43 in a mounting member 39. A set screw 44 has a threaded portion received in threaded bore 43 whereby the distance of the mounting member 39 away from the bridging member 35 may be adjustably limited. Threaded bores 45, 47 are positioned in bridging member 35 on either side of straight smooth bore 41. Respective set screws 49, 51 are received in respective bores 45, 47. As set screws 49, 51 are urged against the mounting member 39, the longitudinal position of mounting member 39 is fixed as limited by set screw 44. By adjusting the set screws 44, 49, 51, the support member 39 can then be adjustably secured in a predetermined position along the longitudinal direction.

Beam 15 is pivotably mounted at one end to upright member 13 via support member 39 as illustrated in FIG. 1. The support member 39 is yoked shaped and includes a pair of spaced arms 53, 55 extending toward the center of the frame 11. Each of the spaced arms 53, 55 includes one of the respective pins 57, 59 projecting transverse to the longitudinal direction. Beam 15 has a bifurcated shape at one end having arms 61, 63 with respective openings pivotably journaled on respective pins 57, 59.

The beam 15 which is a rectangular shaped elongated member has a pivotably joint 17 intermediate the ends. The beam 15 includes a pair of beam sections 67, 69 extending away from the pivotable joint 17 on either side thereof. The joint 17 is formed with an elongated pin 71 extending through bores in respective arms 73 and 75 which form a yoke member. The projecting portion of the beam section 69 extends between the arms 73, 75 and is pivotably connected to pin 71 by a through hole through the projecting portion 77. The end of the beam 15 is pivotably mounted to carriage 19 by a pair of arms 79, 81, on beam section 69 which extend to respective slots 83, 85 in carriage 19. Respective pins 87, 88 extend to the respective arms 79 and 81 and project into the carriage member 19 on either side of the slots 83, 85 so as to form a pivotable joint.

A handle 89 is secured to a beam section 67 and includes a hand gripping section extending in the longitudinal direction over the beam section 69. Due to the fixed pivotably mounting of beam 13 to upright member 13 and the pivotably mounting to carriage 19 which in turn has a movement in a plane along the longitudinal axis, movement of the handle 89 in an up and down direction results in a carriage 19 moving back and forth in a longitudinal direction. As the handle 89 moves upwardly, each of the beam sections 67, 69, form a progressively smaller angle with the pivotably joint 17 being the apex of the angle. As the handle 89 is moved downwardly, the angle between beam section 67 and 69 increases. The beam 15 approaches the maximum extention in the longitudinal direction when beam section 67, 69 are at an angle of about 180°. At this latter point, further downward motion of the pivotably joint 17 is prevented by handle 89 which has an elongated planer surface 93 extending over pivotably joint 65 and at least a portion of each of the beam sections 67, 69.

The carriage 19 includes a follower portion moveably secured to a guide portion on frame 11 for orienting the carriage 19 for movement in the longitudinal direction within a substantially fixed plane. The follower of carriage 19 is in the form of the plurality of arms 95, 97, 99 and 101 projecting outwardly from carriage 19. The guide portion of frame 11 is in the form of a pair of spaced parallel rails 103, 105 extending in the longitudinal direction extending between upright 13 and fixture 21. Arms 95, 97 and 99 each include a straight smooth bore accommodating rail 103. Arm 101 projects outwardly from carriage 19 in the transverse direction and includes a straight bore accommodating rail 105. The spaced arms maintaining the proper orientation of the carriage member 19.

The fixture 21 is provided for positioning the second elongated body or connector body 25 and aligning a plurality of conductors 27 to be terminated to the first elongated body or connector body 23. As illustrated in FIG. 1, the fixture 21 includes a plate 111 detachably secured thereto with a plurality of grooves 117 in an upper surface thereof. The plate 111 is mounted so that the grooves 117 extend in the longitudinal direction and are spaced so as to correspond with the desired spacing required by connector body 25. The elongated connector body 25 to be terminated is held against a side surface 115 of plate 111. The grooves 119 in connector body 25 are oriented in a vertical plane and are adjacent to and below grooves 117 in the plate 111. As illustrated in FIG. 3, the conductors 27 which are oriented in a desired spacing on the plate 11 in a horizontal plane are bent at a right angle over the connector body 25 and placed in corresponding grooves 119 with the excess conductor 27 extending downwardly.

The carriage 19 and fixture 21 include complementary means for severing or cutting the conductors 27. As illustrated in FIG. 3, the carriage 19 includes a cutting blade 121 oriented in a horizontal plane which engages a vertical surface on the fixture 21 so as to cut the conductors 27 therebetween as the carriage 19 is urged toward the fixture 21.

The conductor terminating apparatus of the present invention is ideally suited for terminating conductors 27 of a connector of the type comprising a connector body 25 which orientates the individual conductors 27 and another connector body 23 including a plurality of contacts 29 for engaging the conductors 27 associating with the connector body 25. As previously discussed, connector body 25 is held in a stationary position by fixture 21 so that carriage 19 is urged toward fixture 21 to effect connector termination. The contacts are in alignment with respective conductors 27 so as to make electrical connection therewith and interposition the conductors between connector bodies 23 and 25.

In operation, connector body 25 is positioned on fixture 21 with grooves 119 aligned in a vertical plane. The plurality of individual conductors 27 which may originate from a cable are hand pressed into grooves 117 in the upper surface 113 of plate 111 and bent at right angles so as to be wedged in grooves 119 in connector body 25. The mating connector body 25 is positioned in carriage 19 with contacts 29 projecting outwardly toward the conductors 109. Next, the operator presses downwardly on the handle 89 which urges the pivotable joint 17 downwardly and causes the carriage 19 to move toward fixture 21. As beam sections 67, 69 assume a 180° angle, connector body 23 is urged into engagement with body 25 so that the contacts 29 in the form of opposing knife edges penetrate the insulation and engage the metallic conductor portions of the conductors 27. With the connector bodies 23 and 25 in proper engagement, the handle 89 is lifted so that the carriage 19 is separated from the fixture 21 and the completed connector can be removed. To insure a proper fit between connector body 23 and connector body 25, the support member 39 may be adjusted. Thus the connector terminating assembly of the present invention is particularly suited for terminating the plurality of individual conductor to a connector assembly.

INDUSTRIAL APPLICABILITY

The present invention is suited for terminating a plurality of conductors as may be associated with a cable to a connector.

I claim:

1. Apparatus for terminating a plurality of conductors to a connector of the type having first and second connector bodies adapted to have conductors interpositioned in a spaced array and in engagement with a plurality of electrical contacts, said apparatus comprising an elongated frame extending along a longitudinal direction, a fixture means at one end of said frame adapted to hold a first connector body and a plurality of conductors to be terminated, an upright member at the other end of said frame, a beam having a pivotable joint intermediate the ends thereof with one end pivotably mounted to said upright member, said frame including at least one rail extending in the longitudinal direction intermediate said upright and said fixture, a carriage pivotably mounted to the other end of said beam and slidably mounted to said rail for movement along said longitudinal direction away and toward said fixture member as said pivotable joint moves up and down in a direction substantially normal to said longitudinal direction, said carriage including means for holding and positioning said second connector body whereby said conductors are terminated to a connector in engagement with a plurality of electrical contacts during movement of said carriage toward said fixture.

2. Apparatus according to claim 1 wherein said fixture means includes means for aligning a plurality of conductors along a horizontal plane in the longitudinal direction and said carriage and said fixture means including complementary means for cutting conductors.

3. Apparatus according to claim 2 wherein said upright member includes a support member wherein said one end of said beam is pivotably mounted to said support member, said support member including means for adjustably securing said support member in a predetermined position along the longitudinal direction.

* * * * *